United States Patent [19]

Baker

[11] 4,398,621

[45] Aug. 16, 1983

[54] FIRE ESCAPE

[76] Inventor: Ralph T. Baker, 215 Park Ave., Llangollen, New Castle, Del. 19720

[21] Appl. No.: 261,010

[22] Filed: May 6, 1981

[51] Int. Cl.[3] ..... A62B 1/20

[52] U.S. Cl. ..... 182/48; 193/25 R

[58] Field of Search ..... 182/48, 49; 193/25

[56] References Cited

U.S. PATENT DOCUMENTS

| | | | |
|---|---|---|---|
| 22,324 | 12/1858 | Withers | 182/49 |
| 395,455 | 1/1889 | Reiss et al. | 182/48 |
| 489,915 | 1/1893 | Anidjah | 182/48 |
| 3,580,358 | 5/1971 | Yamamoto | 182/48 |

*Primary Examiner*—Reinaldo P. Machado

*Attorney, Agent, or Firm*—Mortenson & Uebler

[57] ABSTRACT

A fire escape is provided having an upper, supporting entry member and a mesh tube attached to this upper support member, the mesh tube being substantially longer than the building height from which escape is necessary, and a lower, exit-opening support member attached to the lower end of the mesh tube. The mesh openings have a maximum dimension of about two inches. In use, the maximum dimension of the upper entry member is larger than the window or other opening through which escape is necessary. In use, the lower support member and attached mesh tube are lowered to the ground through the window through which escape is to be made. The fire escape is held in place by the upper support member which cannot pass through the window. A person escapes the building by entering the upper entry support member and lowering himself to the ground safely by means of his hands engaging the mesh. In alternate embodiments, the fire escape of this invention can be permanently mounted on the roof of a building or it can be mounted on a movable cart for storage and easy movement, when needed, to a desired escape opening in the building such as a window.

9 Claims, 8 Drawing Figures

FIRE ESCAPE

BACKGROUND OF THE INVENTION

This invention relates generally to fire escapes for an individual's use in evacuating a multiple story building or ship or aircraft on the ground in an emergency situation.

Conventional fire escapes have disadvantages. They are generally finite in number, e.g. one or two per floor in a given building, if provided at all, and fixed in place so that, if smoke and flame approach a lower part of such fire escape, it is useless to persons on floors above that lower part.

As was apparent in the fires at the MGM Grand Hotel in 1980 and the Las Vegas Hilton hotel in 1981, present modern fire escapes are inadequate. In the MGM fire, at least 84 persons died. In the Hilton fire, 8 persons died. In both, helicopters having rescue seats suspended by cables from the aircraft were used to rescue persons from the roofs of the buildings and, in some instances, from balconies and windows. While these rescue efforts saved some lives, this method is very time consuming and terrifying to the inexperienced person being rescued.

Many prior art devices are known which relate to chutes or tubes for use in escaping high-rise buildings in the event of a fire. Exemplary of such devices are those shown in U.S. Pat. Nos. 4,240,520 (1980) and 4,099,596 (1978).

U.S. Pat. No. 4,240,520 discloses a fire escape tunnel for use in exiting high-rise buildings. The tunnel includes an extendable, accordian-pleated tubing made of nylon or canvas fabric padded on its inner side, a ring at its upper end attachable to an escape opening of a building, a lower end of the tubing having a soft landing pad, and an exit doorway so a person sliding or being lowered down the tunnel can step out onto the ground at the exit.

U.S. Pat. No. 4,099,596 discloses a device including a normally-folded flexible tube with a landing pad at its lower end that unfolds to a vertical chute condition, the interior of the tube being slippery to provide against snagging and the like, the unfolded tube being formed with elastic restrictions at successive vertical levels that snub the descent of a person descending inside from free fall to an alleged safe speed.

The present invention overcomes the many disadvantages inherent in these prior fire escapes.

SUMMARY OF THE INVENTION

A fire escape is provided comprising an upper supporting entry member, and a mesh tube attached at its upper end to the upper supporting entry member, the mesh tube being substantially longer than the building height from which escape is necessary, and a lower, exit-opening support member attached to the lower end of the mesh tube.

The openings in the mesh tube have a maximum dimension of about two inches.

The mesh tube has an inside diameter in the range of about 3 feet to about 4 feet.

The upper supporting entry member has a maximum outside dimension D and the mesh tube extends through a window or other opening of said building and downward to the ground, the window having a maximum dimension d, wherein D is greater than d, the fire escape thereby being supported to permit a person to descend therethrough.

The upper supporting entry member is preferably a metal ring having diameter D. Stainless steel is preferred.

In an alternate embodiment, the upper supporting entry member is anchored to the roof of the building.

In still a further embodiment, the upper supporting entry member is anchored to a movable cart whereby, when not in use, the fire escape may be stored conveniently on the cart and, when needed, moved to a desired exit opening in the building.

Optionally an opaque shield encircles at least a part of the upper portion of the fire escape so as to prevent a person using the escape from seeing through the mesh upon entry into the escape.

The mesh tube is preferably fabricated from fire resistant nylon cord or fire resistant elastic bungi cord.

DETAILED DESCRIPTION OF THE INVENTION AND PREFERRED EMBODIMENTS WITH REFERENCE TO THE DRAWINGS

A fire escape is provided having an upper, supporting entry member and a mesh tube attached to this upper support member, the mesh tube being substantially longer than the building height from which escape is necessary, and a lower, exit-opening support member attached to the lower end of the mesh tube. The mesh openings have a maximum dimension of about two inches. In use, the maximum dimension of the upper entry member is larger than the window or other opening through which escape is necessary. In use, the lower support member and attached mesh tube are lowered to the ground through the window through which escape is to be made. The fire escape is held in place by the upper support member which cannot pass through the window. A person escapes the building by entering the upper entry support member and lowering himself to the ground safely by means of his hands engaging the mesh. In alternate embodiments, the fire escape of this invention can be permanently mounted on the roof of a building or it can be mounted on a movable cart for storage and easy movement, when needed, to a desired escape opening in the building such as a window.

Figure 1:
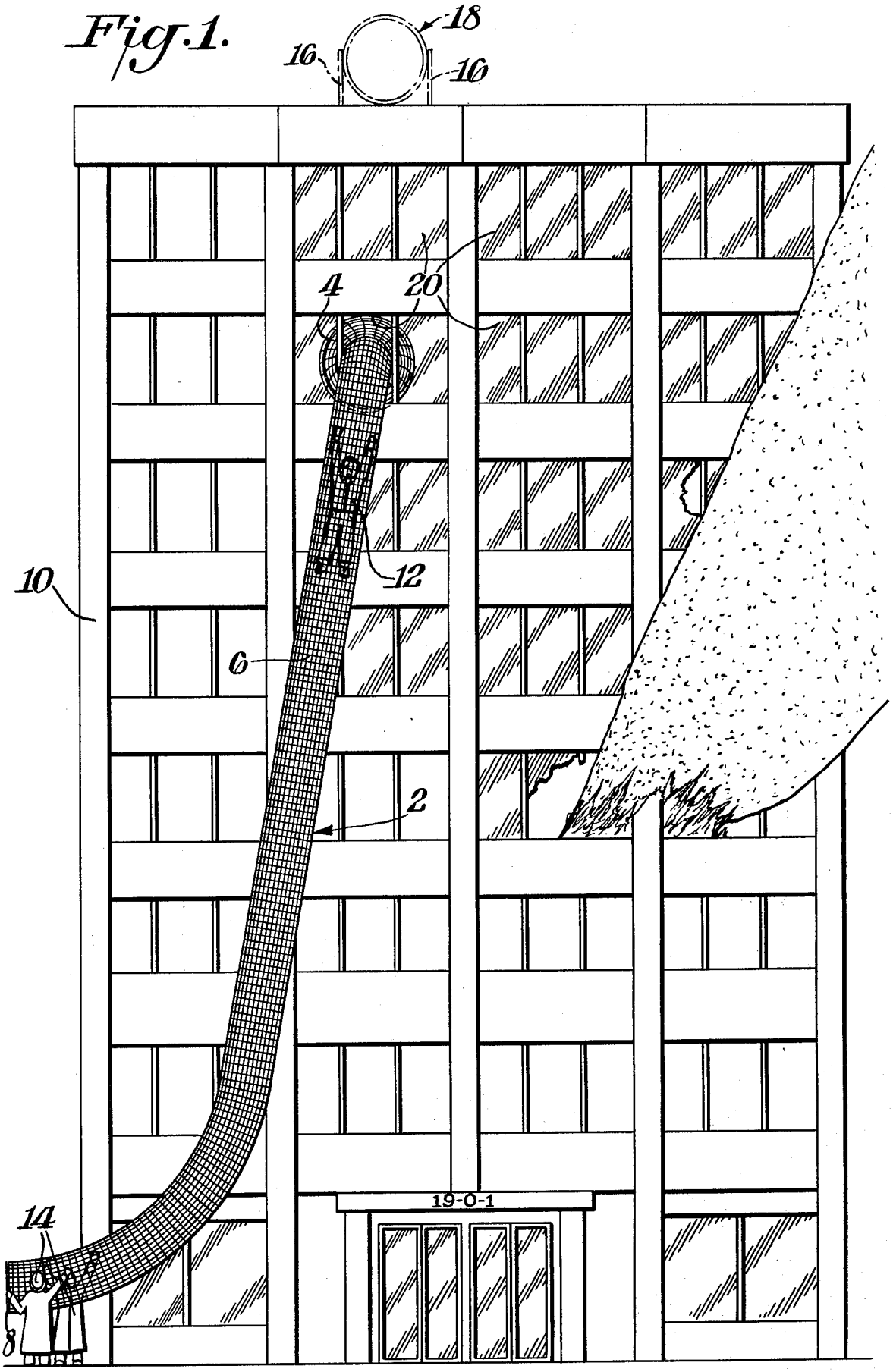
FIG. 1 is a perspective view of the invention showing a person escaping from a building therethrough and being aided by rescue persons on the ground below.

A detailed description of the invention herein is best provided by specific reference to the attached drawings, wherein FIG. 1 shows the fire escape of the invention in use by a person escaping from a blazing building.

In FIG. 1, the fire escape 2 of this invention comprises upper supporting entry opening member 4, partially in phantom, and mesh tube 6 attached to entry member 4 extending through window opening 20, with lower, exit-opening support member 8 attached to the lower end of tube 6. The entry member 4 supports the fire escape and affixes it to window 20 in building 10. The person 12 escaping building 10 enters the opening 4 feet first and lowers himself through the fire escape gradually by means of his fingers engaging the mesh openings of tube 6.

The length of the fire escape 2 is substantially longer than the height of the building from which escape is necessary so that rescue persons 14 on the ground can hold the exit-opening member 8 and guide the fire escape away from flame and smoke and provide a more or less inclined descent. In an emergency, the rescue person could climb upwards inside the tube and reach and assist an infirm person to descend, such as an elderly person or an infant.

The maximum dimension of the openings in mesh tube 6 is in the range of about two inches. In this way, the rectangular, diamond or circular mesh can be grasped only by the fingers and feet cannot enter the mesh. If feet could pass into and through these openings, this could impair descent and, in some cases, could entrap the person attempting to escape.

The mesh tube 6 preferably has an inside diameter in the range of about 3 feet to about 4 feet.

The diameter of the cordage used in the mesh tube 6 is preferably about one-half inch, the preferred material being fire resistant nylon cord or fire resistant elastic bungi cord.

Also shown in FIG. 1 are roof mounts 16 supporting a roof mounted, upper supporting entry member 18. Such roof mounted assembly will be described in detail hereinbelow in connection with describing FIG. 5.

Figure 2:
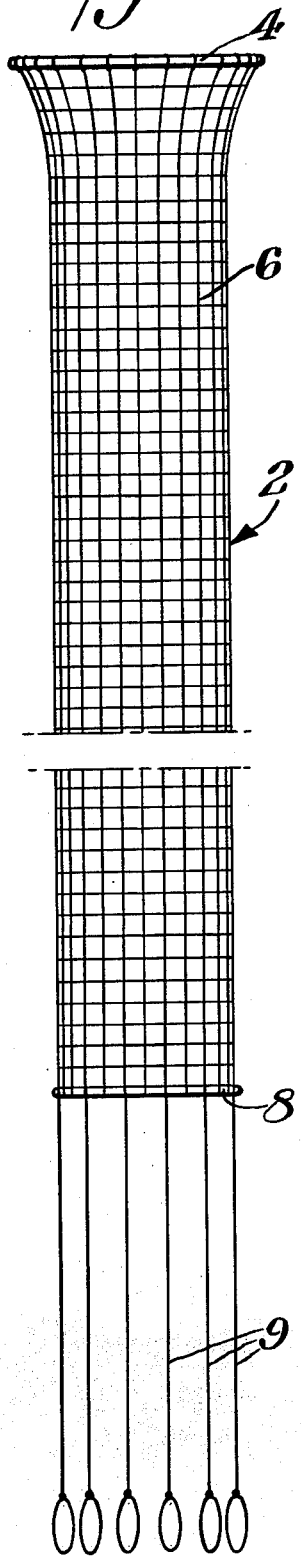
FIG. 2 shows an elevational view of the fire escape of this invention.

FIG. 2 shows a detailed elevational view of the fire escape of this invention. Therein, fire escape 2 is shown comprising upper, supporting entry member 4 having attached to it the mesh tube 6, the lower end of which has attached to it the exit opening, support member 8. The lower support member 8 must have a maximum dimension smaller than the maximum dimension of the building opening through which escape is required so that exit-opening member 8 and mesh tube 6 can be ejected through said building opening and extend downwardly toward the ground. The upper supporting entry member 4 has a maximum dimension larger than said building opening so that this member cannot fit through the building opening and so that this member supports the weight of the fire escape 2 and a person(s) descending to the ground inside the tube. Lines 9 are optionally provided to aid in guiding exit-opening member 8 or to anchor it to a ground affixed member such as a telephone pole or similar device.

Figure 3:
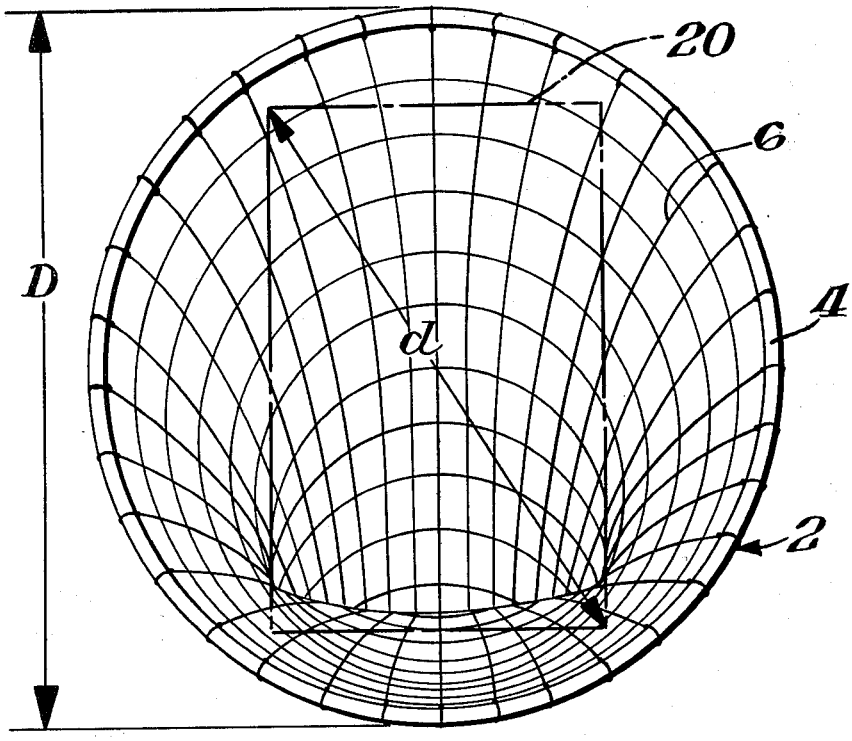
FIG. 3 shows the preferred upper supporting entry member supporting the mesh tube which extends into and through a window of the building and downwardly therefrom, the maximum dimension of the upper support member being D, and the maximum dimension of the window opening being d, wherein D is greater than d.

FIG. 3 is a view looking outwardly through the window 20 through which escape is desired, with the fire escape of this invention affixed in place. The upper entry opening support member 4 is shown to be a circular ring having diameter D. The mesh tube 6 attached to ring 4 extends outwardly through window 20 and downwardly to the ground level. The maximum dimension of window 20, in this case the diagonal, is d wherein D is greater than d. In this way, the upper supporting entry member 4 cannot possibly pass through window 20 and provides effective support for the fire escape and a person(s) descending therethrough.

Figure 4:
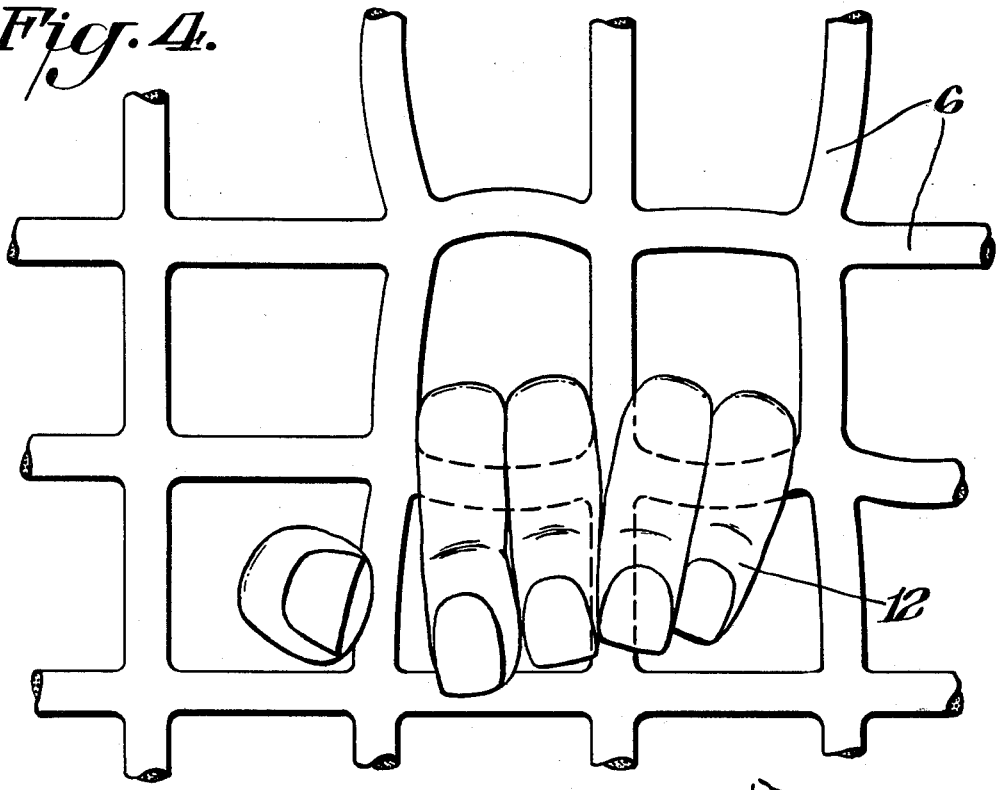
FIG. 4 shows a detailed view of the mesh of the tube of this invention, also showing the hand of a person escaping the building and lowering himself downward through the fire escape.

FIG. 4 indicates the relative sizes of the openings in mesh tube 6 and the fingers of a person descending through the tube. It is an important feature of this invention that these openings be small enough so that the feet of a person descending through the mesh tube cannot pass through these openings so as to entangle and entrap a person attempting to escape.

Figure 5:
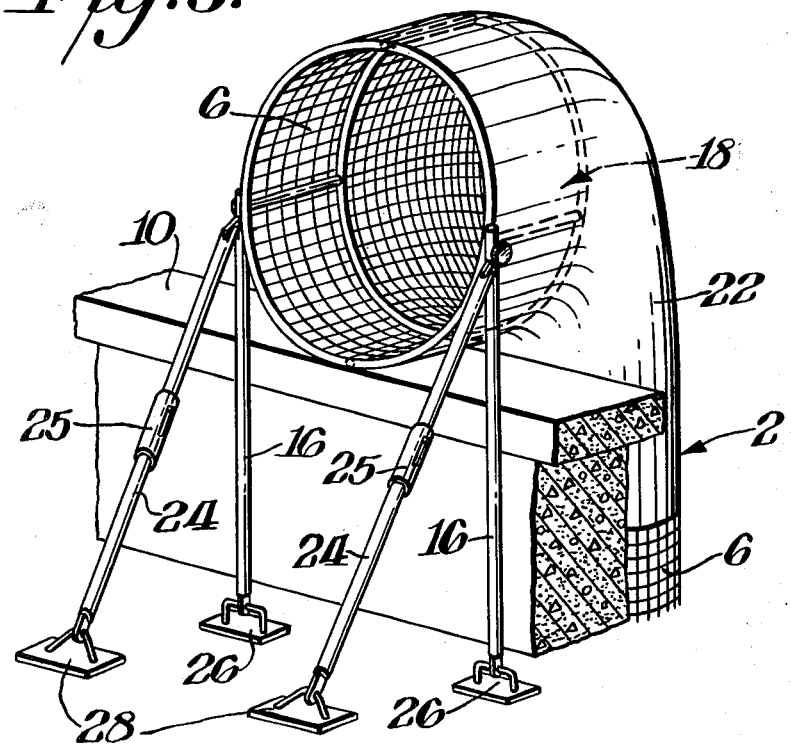
FIG. 5 shows a perspective view of the fire escape of this invention mounted on the rooftop of a building, including an optional shield encircling the mesh tube at the upper end thereof.

FIG. 5 shows a detailed view of a roof-mounted assembly of this invention. Therein, the roof mounted upper support member 18 is shown supported in a vertical position upon the wall extension 10 of the building by means of roof mounting poles 16 and supporting struts 24. The mounting poles 16 and supporting struts 24 are anchored to the roof as shown by roof anchors 26 and 28. When being stored, it is seen that the fire escape 2 can be placed upon the roof in a folded manner with support poles 16 being oriented flat on the roof. The fire escape and support mechanism can be covered by a tarpaulin or other suitable covering means for storage. Sleeve members 25 provide for rigidly affixing support struts 24 in place when needed.

Figure 6:
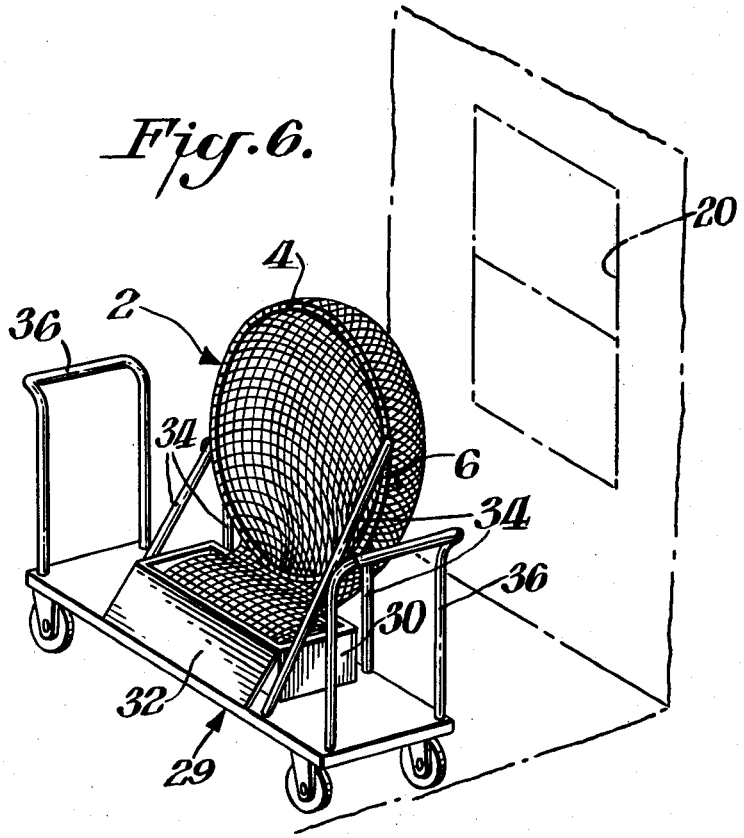
FIG. 6 shows the fire escape of this invention mounted upon a wheeled cart, the cart providing convenience for storing and for moving the fire escape to a desired window or other building opening when needed.

In FIG. 6, the fire escape 2 is shown having upper entry support member 4 rigidly affixed to cart 29 having handles 36 by rigid support members 34. The mesh tube 6 is shown stored in box 30 having lid 32. Where needed, the fire escape can be wheeled to a window and deployed.

While the cart-mounted fire escape shown in FIG. 6 has been described in connection with rigid support members 34, it will be clear to one skilled in the art that the fire escape embodiment shown in FIG. 2 could be stored on cart 29 without being rigidly attached thereto, and such fire escape could be easily moved to a desired building opening and deployed for escape.

Figure 7:
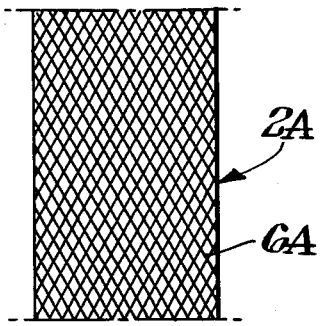
FIG. 7 shows an alternate, diamond-shaped mesh pattern for the fire escape.

FIG. 7 shows an alternate fire escape 2A having a diamond-shaped mesh opening pattern 6A.

Figure 8:
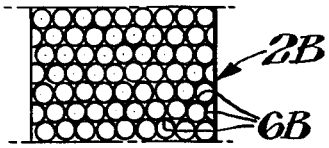
FIG. 8 shows an alternate, circular-shaped mesh pattern for the fire escape.

FIG. 8 shows an alternate fire escape 2B having a circular-shaped mesh opening pattern 6B.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

I claim:

1. A fire escape comprising an upper supporting entry member and a mesh tube attached at its upper end to said upper supporting entry member, said mesh tube being substantially longer than the building height from which escape is necessary, and a lower, exit-opening support member attached to the lower end of said mesh tube, wherein the openings in said mesh tube have a maximum dimension of about two inches, said tube having inside diameter sufficiently large so as not to restrict passage of a person escaping therethrough, whereby said escaping person can control his rate of descent manually by grasping the mesh anywhere within said tube.

2. The fire escape of claim 1 wherein said mesh tube has an inside diameter in the range of about 3 feet to about 4 feet.

3. The fire escape of claim 1 wherein said upper supporting entry member has a maximum outside dimension D and said mesh tube extends through a window of said building and downward to the ground, said window having a maximum dimension d, wherein D is greater than d, the fire escape thereby being supported to permit a person to descend therethrough.

4. The fire escape of claim 3 wherein said upper supporting entry member is a metal ring having diameter D.

5. The fire escape of claim 1 wherein said upper supporting entry member is anchored to the roof of said building.

6. The fire escape of claim 1 wherein said upper supporting member is anchored to a movable cart whereby, when not in use, the fire escape may be stored conveniently on said cart and, when needed, moved to a desired exit opening in said building.

7. The fire escape of claim 1 having an opaque shield encircling at least a part of the upper portion thereof so as to prevent a person using the escape from seeing through said mesh upon entry into the escape.

8. The fire escape of claim 1 wherein said mesh tube is made of fire resistant nylon cord.

9. The fire escape of claim 1 wherein said mesh tube is made of fire resistant, elastic bungi cord.

* * * * *